United States Patent [19]

Demenais

[11] Patent Number: 4,551,055

[45] Date of Patent: Nov. 5, 1985

[54] APPARATUS FOR CHARGING SOLIDS UNDER COMPRESSION INTO A RECEPTACLE

[75] Inventor: Claude Demenais, Rochefort, France

[73] Assignee: Societe Industrielle de Transports Automobiles "SITA" , France

[21] Appl. No.: 515,560

[22] Filed: Jul. 20, 1983

[30] Foreign Application Priority Data

Jul. 23, 1982 [FR] France ..... 82 12876

[51] Int. Cl.[4] ..... B65F 3/20

[52] U.S. Cl. ..... 414/293; 414/501; 414/525 R

[58] Field of Search ..... 414/472, 501, 525 R, 414/293

[56] References Cited

U.S. PATENT DOCUMENTS 3,940,006 2/1976 Smith ..... 414/525 X 4,460,307 7/1984 Durant et al. ..... 414/525

*Primary Examiner*—Robert G. Sheridan

*Attorney, Agent, or Firm*—Ostrolenk, Faber, Gerb & Soffen

[57] ABSTRACT

Apparatus for charging materials under compression into a receptacle, from a hopper, with the aid of charging and compressing means displaceable on guides, by means of actuating units, particularly jacks, characterized in that the charging and compressing means are constituted by two components (1,6) hinged (3) to one another at the lower end of an upper component (6).

13 Claims, 8 Drawing Figures

APPARATUS FOR CHARGING SOLIDS UNDER COMPRESSION INTO A RECEPTACLE

The invention relates to an improved apparatus for charging various solids, under compression, into a receptacle. It relates particularly to the charging of materials, especially domestic or industrial refuse or waste, into a skip. The new apparatus is usable for various stationary or movable containers or skips and, more particularly, for refuse collecting vehicles.

Apparatus of the kind concerned with the present invention comprises movable means, generally known under the name blade or plate, for pushing the material into the receptacle; these means, mounted in a charging hopper, are moved by driving means placed symmetrically on one side and the other in the width direction of the blade. In certain prior constructions, guides were provided for these mobile pushing means, in order to impose the desired trajectory on the latter during operation. This is the case with U.S. Pat. No. 3220586, where the guides comprise an inclined part and a horizontal part and define the operation of the blade in a 3-stage cycle. An improvement was subsequently provided, according to French Published Patent Application No. 2436092; the blade and its jacks are connected to a beam sliding on a uniformly curved guide and the operating cycle involves 4 stages.

The present invention adds important advantages to the relevant prior technique, both as regards the construction of the apparatus and also its efficacy. The invention allows charging under strong compression of solid materials of all kinds, at an increased hourly tonnage, with an apparatus which is much lighter than those of the known forms of apparatus; it is possible, for example, to gain 30% in the weight of the apparatus, while treating the same hourly weight of domestic refuse with an equivalent or greater compression than in the past. Another advantage of the apparatus according to the invention is that it is possible to charge the materials into the hopper at any time during operation, which makes the apparatus resemble continuous forms of equipment.

The invention gives excellent results in the operation of the compression charging means according to a 4-stage cycle, but it can apply also to operation to a different working rhythm.

In the apparatus according to the invention, the movable means for pushing and compressing the materials to be charged are constituted by two components, both undergoing displacement in lateral guides and hinged to one another so as to allow their translation along the guides, as well as their reciprocal pivoting. The mounting is such that, during operation, these means are both displaced simultaneously, following a triangular configuration with respect to the means which produce this displacement.

Each of the two components forming the movable charging means includes a roller running in the guide at its upper end, whilst the hinge between them lies outside the planes through the guides, in particular, below these planes. Preferably, the latter hinge interconnects the lower end of the upper component to the body of the lower component between about Δ and ½ of the length of the latter, counted from its upper end.

As in similar apparatus, the driving means, usually jacks, are provided according to the invention as two pairs disposed at the lateral sides of the movable charging components.

According to a particular feature of the invention, both of the two pairs of driving means are connected to the upper end or head of the lower charging component; one of these pairs is connected at its opposite end to the upper end of the upper component, on the guide rail, whilst the opposite end of the second pair of driving means is hinged at the top to the wall of the apparatus, particularly to the hinge supporting the door of the hopper.

The charging components are massive panels, the anterior face of which, that is, that turned toward the interior of the receptacle, preferably has an appropriate profile for the action of pushing and compression to be carried out.

According to an important characteristic of the invention, the lower component comprises a flat panel only in its lower part, below its hinge joint with the upper component. In other words, the top of this lower component is hollowed, which allows charging of the hopper even during operation of the apparatus. The preferred form of the lower component is such that its section, in a vertical plane parallel to the plane passing through the guides, is substantially triangular. As regards the upper component, it is advantageous for it to have a stepped profile, reinforcing the component and contributing to the retention of the treated material, when the hopper is open.

The invention is illustrated non-limitatively by the description which follows of one of its particularly advantageous embodiments.

The accompanying drawings show an apparatus according to the invention in various stages of the operating cycle.

FIG. 1 is a diagrammatic section through a longitudinal vertical plane (X—X FIG. 5) of the charging hopper of a refuse collecting vehicle, corresponding to the start of the first stage of the operating cycle;

FIG. 2, analogous to FIG. 1, shows the start of the second stage of the operating cycle;

FIG. 3, analogous to the foregoing, corresponds with the third stage of the cycle;

Figure 3:
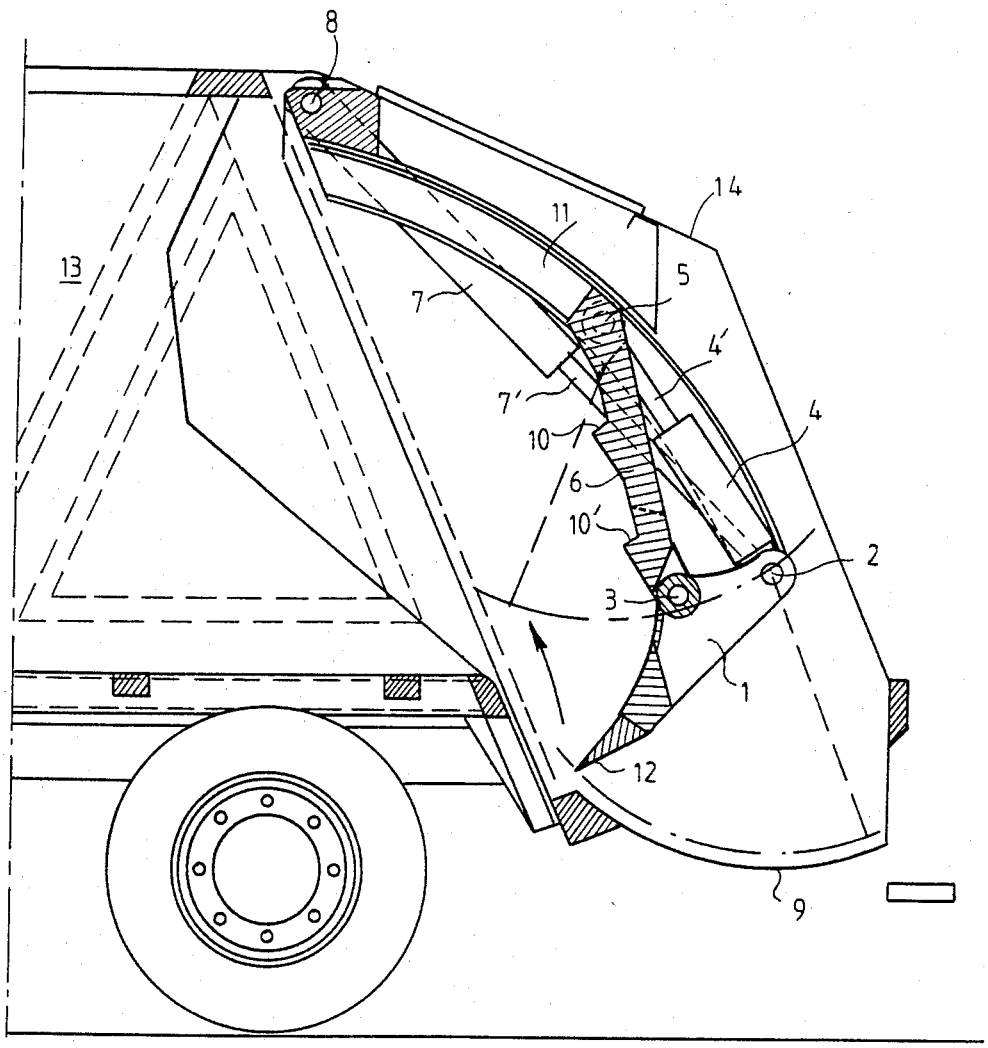
Figure 5:
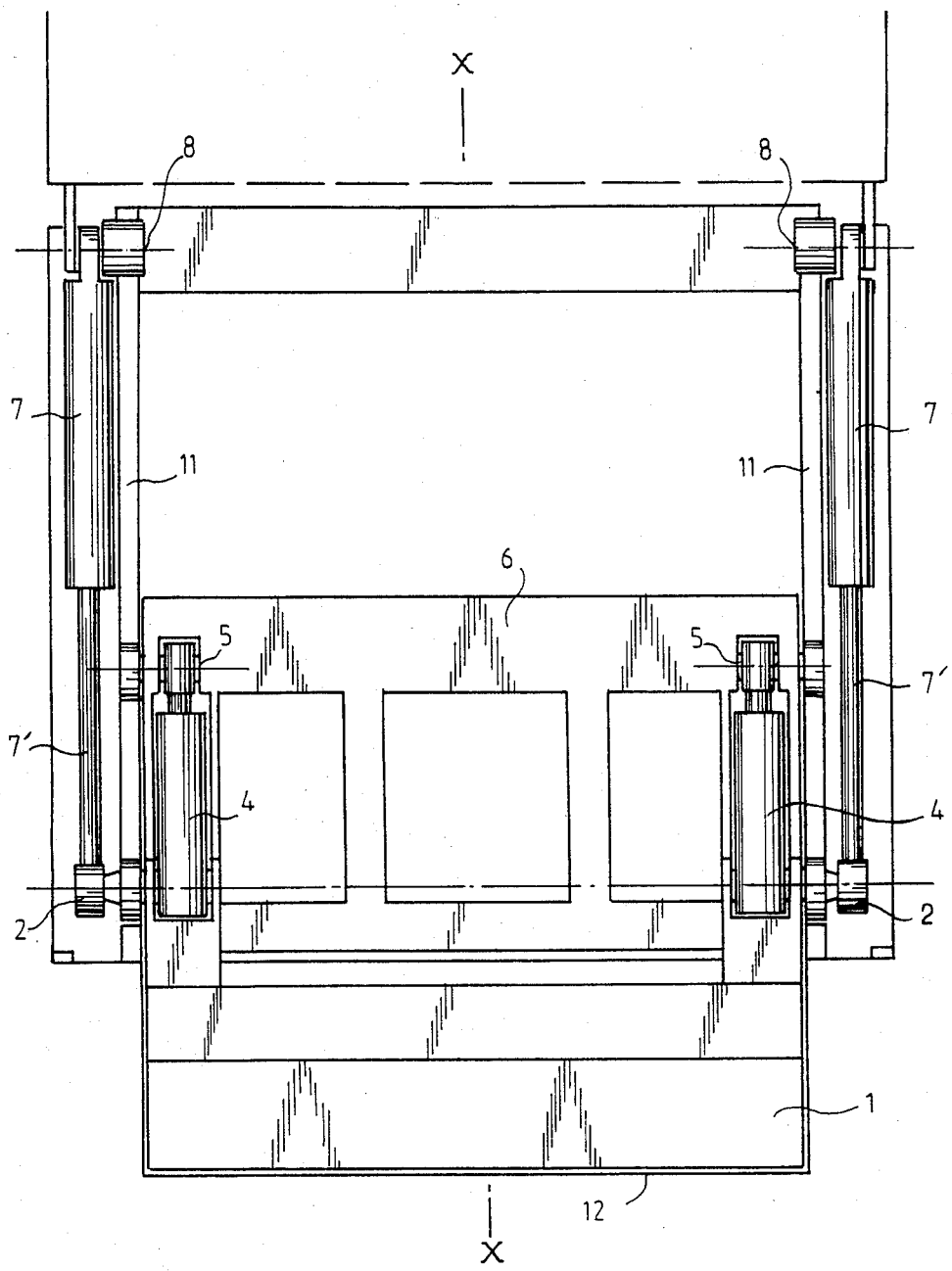
FIG. 5 is an elevational view from the front over the whole width of the device corresponding to the low position of the charging blade, that is FIG. 2.

The drawings show an assembly of two charging components 1 and 6, undergoing displacement in the guide 11, with their jacks 4 and 7, the whole mounted in a hopper 9 of standard type, closed at the top by flanges 14. These components are shown in all the figures, but are best seen in FIG. 3. In FIG. 5, it will be seen that there are a pair of guides 11, a pair of jacks 4 and a pair of jacks 7, as well as a pair of each of the hinges. However, for simplicity in the description, reference will only be made to one of each of these means.

The invention has this originality, with respect to the known art, that the two pushing and compressing components 1 and 6 are hinged to one another outside the guide 11, at 3, whilst the two jacks 4 and 7 are both attached to the same hinge 2 at the upper end of the component 1.

Thus the new structure comprising the guide or roller track 11 curves in the form shown, but can be straight; in this guide, at 5, runs a roller carried by the upper edge of the movable panel 6 which constitutes the upper component of the charging and compressing means.

Lower down, in the same roller track 11, a roller moves at 2 which is connected to the upper end of the blade 1 forming the lower component of the charging means.

Figure 6:
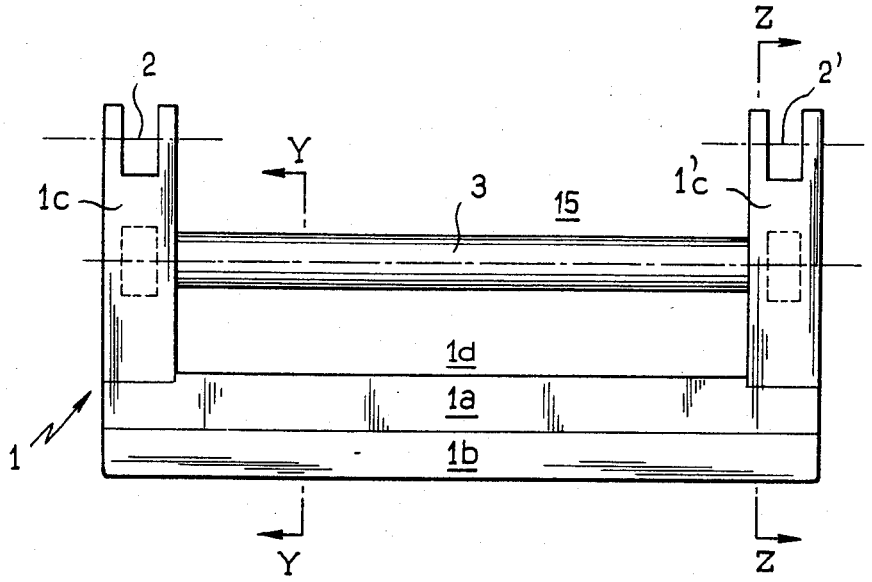
FIG. 6 is an elevational view of the front of the lower compression component, alone.

According to a particular feature of the invention, the blade 1 has a generally U-shaped form; its operative part 1*a*–1*b*, which pushes the material from right to left according to FIGS. 1, 2, 3, 4, 7 and 8, carried by two arms 1*c* and 1′*c*, shown in FIG. 6. These arms turn about the axis 3 which hinges them to the compression component 6; they also pivot about the axes 2, 2′ on on the guides 11 where the jacks 4 and 7 are attached. An open space 15 is thus produced above the axis 3, through which the material can be introduced into the hopper, irrespective of the position of the blade 1.

The operative part 1*a*–1*b* of the blade 1 is preferably a reinforced caisson-like construction which allows high forces to be exerted by means of a blade of low weight. The height of the arms 1*c* and 1′*c* is generally about 0.75 to 4 times that of the operative part 1*a*–1*b* 1*b* and preferably 1 to 3 times.

Figure 7:
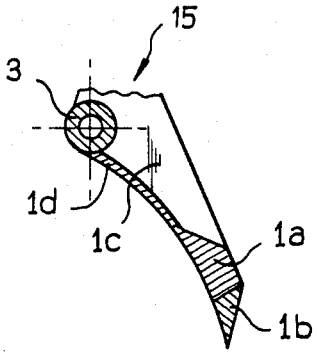
FIG. 7 shows a transverse section through the lower component in a vertical plane Y—Y of FIG. 6.

In FIG. 7, only the section in the plane Y—Y at the lower end 12 of the part 1*b* of the blade up to the axis 3 is shown. The section through this plane shows the operative part 1*a*–1*b* (shaded) of the blade 1, above which the open space 15 is disposed, that is the hollow part between the two arms 1*c* and 1′*c*; 1*d* is a wall of the blade.

Figure 8:
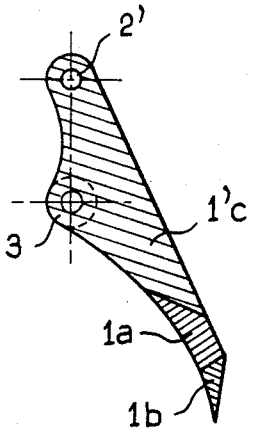
FIG. 8 is a transverse section of the lower component in a vertical plane Z—Z of FIG. 6.

In contrast, FIG. 8, which is a vertical section of the arm 1′*c* and the operative parts 1*a*–1*b* in the plane Z—Z, allows both the arm 1′*c* and the part 1*a*–1*b* to be seen in section (shaded).

As FIGS. 1 to 4 are vertical sections through the plane X—X of FIG. 5, the operative part 1*a*–1*b* in section (shaded) and the arm 1′*c* at the end of the axis 3 (non-shaded) are shown; however, for clarity in the drawing, references 1*a,b,c*, 1′*c* are omitted from FIGS. 6 to 8.

The base of the panel 6 is hinged at 3 to the blade 1, which gives a charging assembly 1–6 which is actuatable under the action of the associated jacks.

The top of the panel 6 at 5 is connected to the head 2 of the blade 1 by a jack 4; the piston rod 4′ of this jack is hinged at 5 and the cylinder at 2. In this way, as the two ends 2 and 5 of the jack 4 are located in the track 11, the jack always remains aligned parallel to a tangent to the track 11.

A second jack 7 is mounted between the flange 14 of the hopper and head 2 of the blade 1. The end of the cylinder 7 is hinged at 8 to the flange of the apparatus, whilst the piston rod 7′ of this jack is connected to the upper end 2 of the blade 1, that is, to the same point where the base of the cylinder of the first jack 4 is hinged.

The assembly thus formed by the blade 1, the panel 6 and the jack 4 constitutes a triangle which is deformable, under the action of the jack 4, for each of the positions determined by the jack 7 when this immobilizes the hinge joint 2.

The jacks are preferably hydraulic for a vehicle-mounted apparatus, but can be electric, particularly for a stationary installation.

As shown in FIGS. 1 to 4, 7 and 8, the preferred profile of the blade 1 is substantially a triangle having an obtuse angle at the top 3 and an acute angle at the lower end 12. The obtuse angle is preferably from 100° to 125°, whilst that at the end 12 measures 10° to 35°. The shape and position of the components at the end 12, with respect to the edge of the hopper 9, is such that the risk of accidents is considerably reduced.

The fact of having two hinged components 1 and 6 for charging and compressing the material, instead of one, allows a lower thickness to be given to each and thus gains very substantially in the weight and cumbersomeness of the apparatus.

Figure 1:
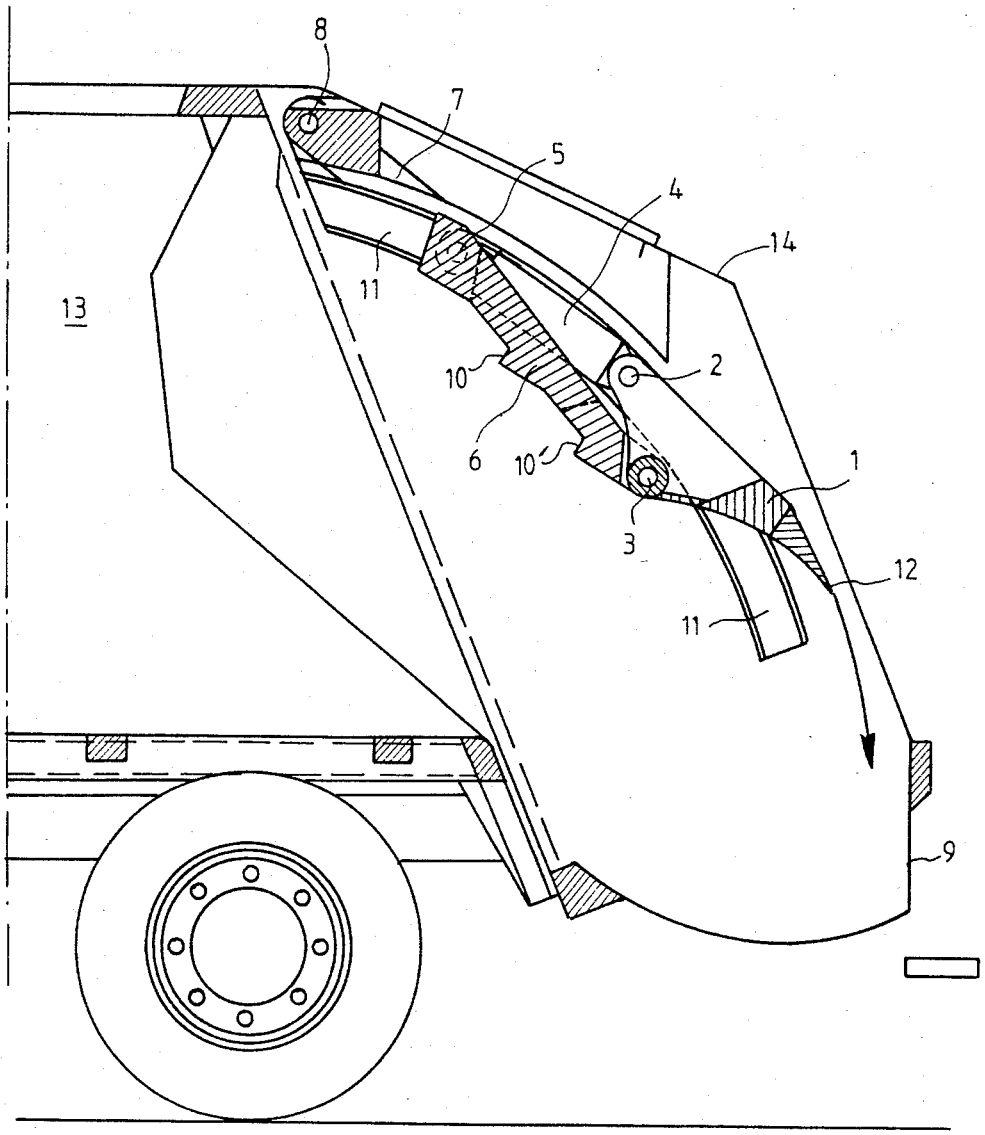

As the starting position for explaining operation of the apparatus according to the invention, reference is made to FIG. 1: the components 1 and 6 occupy their highest place on the roller track or guide 11, that is the rollers of the hinges 2 and 5 are located at their highest positions. The jacks 4 and 7 are completely retracted, which means that the blade 1 and the panel 6 are aligned along the guide 11, one being the prolongation of the other; the angle between 1 and 6 is thus the smallest of all of those which these components can make between them during the course of operation.

Figure 4:
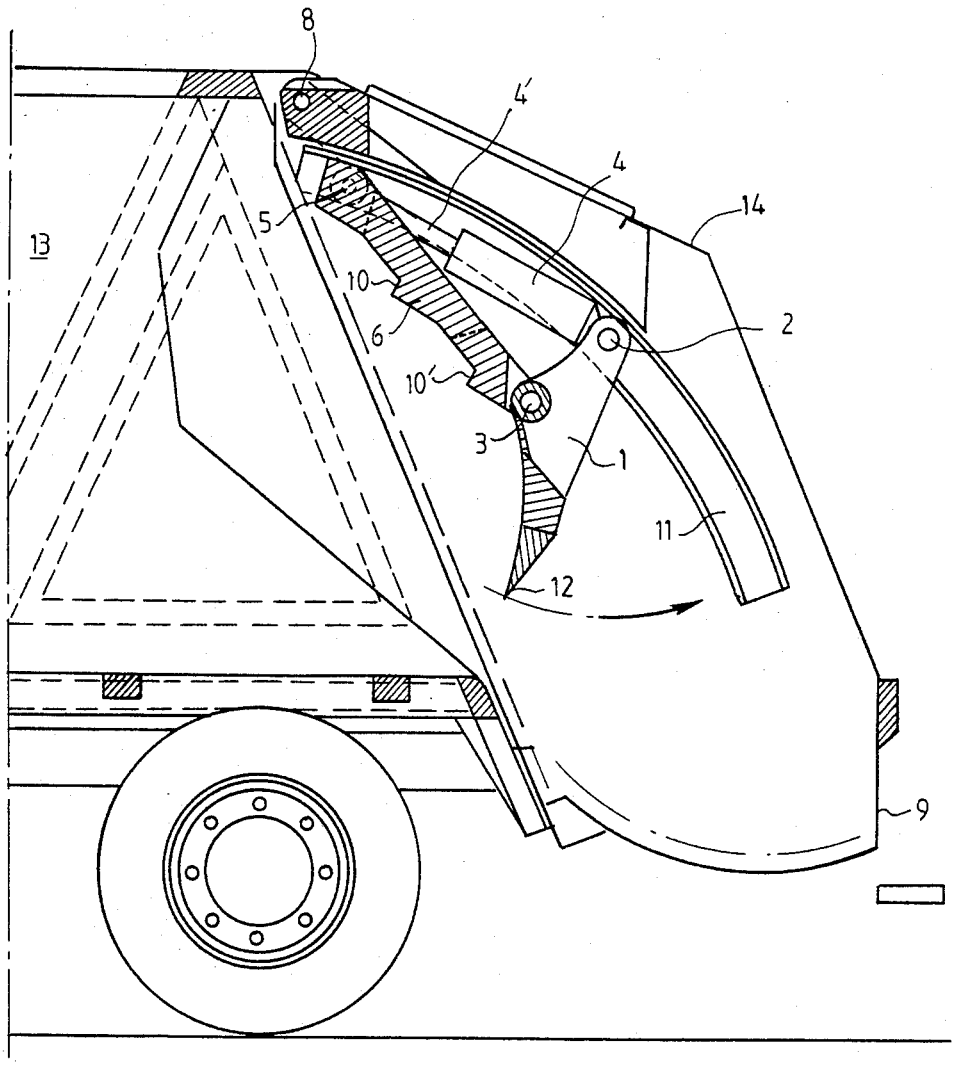
FIG. 4 illustrates the initial position at the fourth stage of the cycle.

For good understanding of the drawing, it should be noted that, in FIGS. 1 and 4, the roller track 11 is that shown at the right in FIG. 5; the left track is not shown in FIGS. 1 to 4, as it is situated in the part removed by the section plane.

Figure 2:
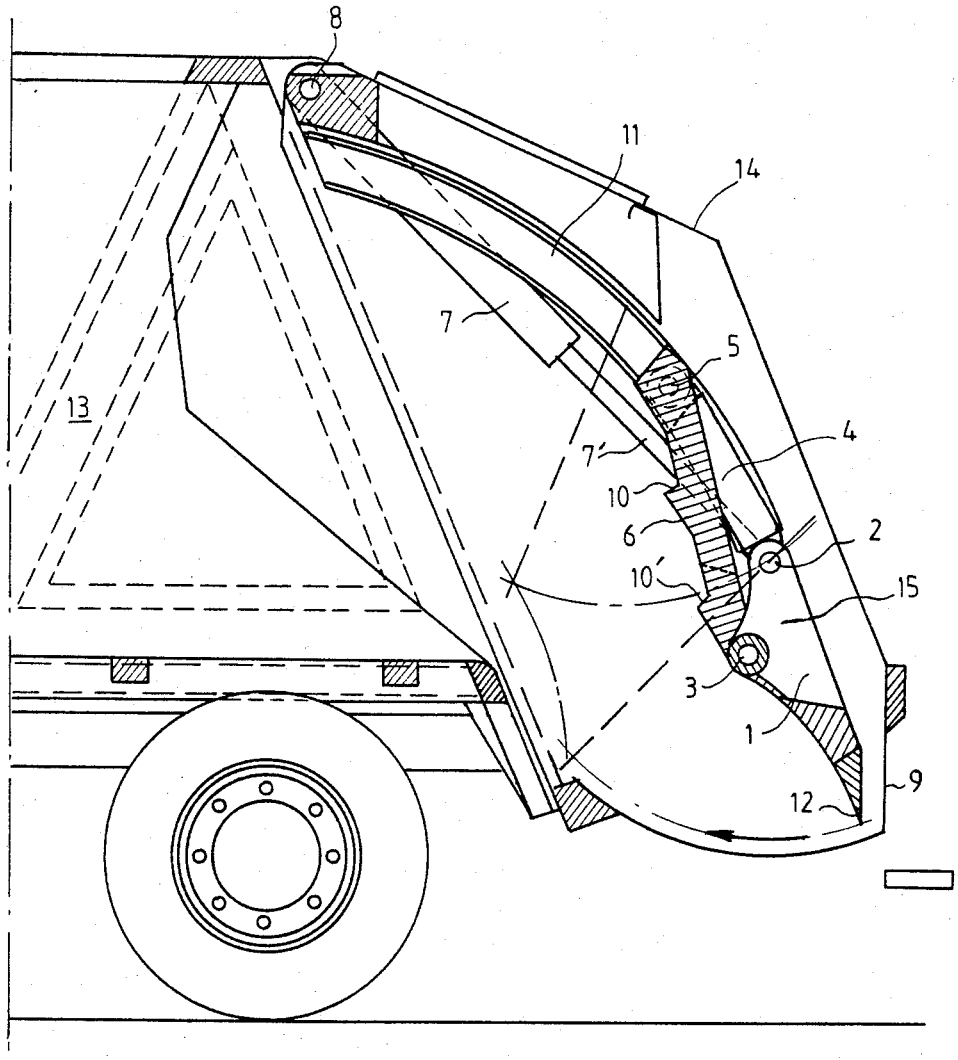

The position according to FIG. 1 constitutes the start of the first stage of the operating cycle. This stage consists in pressure expansion of the jack 7, which pushes the hinge 2 towards the base of the track 11. This causes displacement of the assembly 1-4-6 forwards and downwards, as indicated by the arrow at the end 12 in FIG. 1. Thus the first stage of the cycle consists in moving the assembly 1-4-6 into the position of FIG. 2, that is, until arrival of the end 12 of the blade 1 at the base of the hopper 9. At this instant, the entry to the receptacle 13 is closed by the panel 6 and the blade 1, as shown in FIG. 2. However, due to the special form of the blade 1 described above, an open space 15 is provided between the axis 2 and the operative part 1*a*–1*b* of the blade 1.

The presence of the open space 15 is an originality of the invention; it provides the advantage of being able continuously to charge the hopper even during the stage of FIG. 2 which, in apparatus according to the prior art, corresponds to a stoppage in charging.

The second stage of the operating cycle is the change from the situation according to FIG. 2 to that of FIG. 3. The piston rod 7′ of the jack 7 is entirely extended and is left in that state, so as to maintain the hinge 2 in the place shown in FIG. 2. The jack 4 is actuated, its piston rod 4′ then pushes upwards the hinge 5, which moves upwards the upper edge of the panel 6. This produces traction of the panel 6 on the hinge 3 connecting it to the blade 1. Thus the triangle 1-4-6 is subjected to deformation and produces the operation of charging the material from the hopper 9 into the receptacle 13; the blade 1 pivots about the hinge 2 in the clockwise direction along the trajectory indicated by an arrow located adjacent the base of the hopper 9 (FIG. 2), thus pushing the material towards the receptacle 13; at the same time, the panel 6 advances towards the entry to this receptacle and exerts a precompression on the material. The stepped regions 10,10' of the panel 6 improve resistance of the latter and retention of the materials.

The duality of these effects, pushing of the blade 1 and pre-compression by the panel 6 due to the special structure according to the invention, proves to be extremely useful in practice, yielding an improved efficacy with respect to the known art.

The third stage of the cycle, in operation of the apparatus, starts when the components of the apparatus have attained the position shown in FIG. 3. Retraction of the piston rod 7' of the jack 7 then occurs, the jack 4 remaining extended; the two components 1 and 6 are then displaced upwards, in the direction of the entry to the receptacle 13, as shown by the arrow in FIG. 3. This is the compression phase, which takes place whilst the assembly moves towards the position of FIG. 4.

The piston rod 7' of the jack 7 is withdrawn and then the configuration according to FIG. 4 is attained, namely the end of charging under compression. To resume the initial position of FIG. 1, the piston rod 4' of the jack 4 is retracted, which causes the blade 1 to pivot about the hinge 2 in the direction contrary to that of the second stage of the cycle; the trajectory of the blade 1 is shown by an arrow in FIG. 4. This is the fourth stage of the cycle, return to the rest and opening position of FIG. 1.

In fact during operation, both of the components 1 and 6 are displaced relative to the guides 11 and also with respect to one another.

It will be clear from the description above that all the operation comprising the synchronized effects of the two components 1 and 6 is due to the very simple successive actions of the two jacks.

The four stages of the cycle are effected by the following simple actions:

1st stage—expansion of the jack 7
2nd stage—expansion of the jack 4
3rd stage—retraction of the jack 7
4th stage—retraction of the jack 4.

It is thus easy to program operation of the apparatus according to the invention.

As regards the location of the jacks in the apparatus, these drive means remain free from any soiling or deterioration by the material treated; as shown in FIG. 5, the jacks 4 and 7 are mounted at the sides of the apparatus, outside the hopper 9.

I claim:

1. Apparatus for charging material under compression into receptacle (13) from a hopper (9); said apparatus comprising at least first and second compression elements (1, 6), an elongated guide means (11) for guiding the movement of said first and second compression elements (1, 6), and first and second drive means (4, 7); said first and second compression elements (1, 6) having respective spaced first and second pivotal connection regions; a first pivotal connection means (3) pivotally connecting together said first connection regions of said first and second compression elements (1, 6); second and third pivotal connection means (2, 5) connected to said second pivotal connection regions of said first and second compression elements (1, 6) respectively; said second and third pivotal connection means (2, 5) being slidably guided by said guide means (11) and movable along respective paths defined by said guide means; said first and second drive means (4, 7) each having first and second connection regions respectively which are operable to be variably spaced apart; said first connection region of said first drive means (4) connected to said third pivotal connection means (5); said first connection region of said second drive means (7) connected to a fixed pivot (8); said second connection region of each of said first and second drive means (4, 7) connected to said second pivotal connection means (2).

2. The apparatus of claim 1, wherein said first pivotal connection means (3) is disposed beneath said elongated guide means (11).

3. The apparatus of claim 1 or 2, which further includes roller means connected to said third pivotal connection means (5); said roller means being disposed within said guide means (11).

4. The apparatus of claim 1 or 2, wherein said first and second drive means each comprise a piston and a cylinder relatively movable in said piston.

5. The apparatus of claim 3, wherein said first and second drive means comprise a piston and a cylinder relatively movable in said piston.

6. The apparatus of claim 1 or 2, wherein said second compression element is a panel member of relatively large area.

7. The apparatus of claim 4, wherein said first and second compression elements (1, 2) comprise a blade member and panel member, respectively, and wherein said first and second drive means (4, 7) comprise respective cylinders and movable pistons received within said cylinders; said blade (1), panel (6) and first drive means (4) being pivotally connected to define a triangular configuration which is deformable under the action of the first drive means (4) to conditions related to the position of said cylinder and said piston of said second drive means (7); said second drive means (7) operating to immobilize the pivotal connection between said first drive means (4) and said blade (1).

8. The apparatus of claim 7, wherein said first pivotal connection means (3) between said panel (6) and said blade (1) is disposed at about $\frac{1}{3}$ to $\frac{1}{2}$ of the distance of said blade (1) from said second pivotal connection means (2) on said guide means (11).

9. The apparatus of claim 7, wherein said triangular configuration has an obtuse angle at said pivotal connection means (3) and an acute angle at the lower end of said triangular configuration.

10. The apparatus of claim 1 or 2, wherein said first compression element (1) is a blade having a concave configuration adapted to compress materials in said hopper (9).

11. The apparatus of claim 9, wherein said obtuse angle is from about 100° to about 125° and said acute angle is from 10° to 35°.

12. The apparatus of claim 1 or 2, wherein said second compression element (6) is a large area panel having a step profile (10, 10').

13. The apparatus of claim 1 or 2, wherein said first compression element (1) is comprised of transverse parts **(1*a*, 1*b*) carried at its opposite ends by respective first and second arms (1*c*, 1'*c*); said respective arms being pivotally mounted to said first pivotal connection means (3); said second compression element comprising a panel (6); said panel (6) being connected to said first and second drive means whereby an open space (15) is provided above the axis of said first pivotal connection means (3)**.

* * * * *